US005922981A

United States Patent [19]

Ballister

[11] Patent Number: 5,922,981

[45] Date of Patent: Jul. 13, 1999

[54] PERSONAL LIGHTING SYSTEM FOR DRUMMERS

[76] Inventor: Matthew Ballister, 375 Mercer Ave., Union, N.J. 07083

[21] Appl. No.: 08/912,328

[22] Filed: Aug. 18, 1997

[51] Int. Cl.[6] ..... A63J 17/00

[52] U.S. Cl. ..... 84/464 A

[58] Field of Search ..... 84/411 R, 411 M, 84/414, 464 R, 464 A, DIG. 12

[56] References Cited

U.S. PATENT DOCUMENTS

| | | | |
|---|---|---|---|
| 3,346,732 | 10/1967 | Crusius | 84/464 A |
| 3,869,699 | 3/1975 | Haller et al. | 340/148 |
| 4,091,706 | 5/1978 | Ludwig | 84/464 A X |
| 4,353,008 | 10/1982 | Dorfman | 315/114 |
| 5,083,064 | 1/1992 | Jones, Sr. | 315/294 |
| 5,280,742 | 1/1994 | Vergara | 84/411 |
| 5,402,702 | 4/1995 | Hata | 84/464 R |
| 5,461,188 | 10/1995 | Drago et al. | 84/464 R |
| 5,739,457 | 4/1998 | Devecka | 84/743 |

*Primary Examiner*—William M. Shoop, Jr.
*Assistant Examiner*—Jeffrey W. Donels
*Attorney, Agent, or Firm*—Walter Tencza, Jr.

[57] ABSTRACT

An apparatus and method for activating drum lights in response to audio signals is disclosed. A drum having a light and a transducer within its inner area is disclosed. The light and the transducer are attached to a single bracket which is attached to the drum. Circuitry is disclosed for connecting the transducer with the light and causing the light to turn on when the drum is hit with sufficient force. The bracket is attached to a metal tube which has been placed through an existing air hole of the drum.

16 Claims, 6 Drawing Sheets

Schematic

PERSONAL LIGHTING SYSTEM FOR DRUMMERS

FIELD OF THE INVENTION

This invention relates to the field of providing light in response to music and more particularly to music played on a drum.

BACKGROUND OF THE INVENTION

U.S. Pat. No. 3,869,699 to Haller et al. discloses the use of audio signals from audio source 21, such as from a tape recorder, record player, or other source of audio information to control voltage controlled dimmers 24 and lamp loads 32–35. (Haller, Col. 2, lns. 26–55). U.S. Pat. No. 5,083,064 to Jones Sr. discloses flashing incandescent and fluorescent lamps in response to speech or music. U.S. Pat. No. 5,280,742 to Vergara discloses lights within a drum which are controlled by switch means responsive to vibrational motion of the drum skin (or head). (Vergara, col. 2, lns. 34–37) The switch means disclosed are an inertia switch or a diaphragm switch. (Vergara, col. 4, ln. 66–col. 5, ln. 2). These switches open and close at the frequency of the beating of a drum stick on the drum skin. (Vergara, col. 4, lns. 62–65). In Vergara, each light 53 within the drum is supported in a socket 55 which is attached to foam liner 17 but not to shell 15. (Vergara, col. 4, lns. 38–50) It appears that the switches are clamped to the shell 15. (Vergara, Col. 5, lns. 3–9; col. 5, lns. 30–37).

U.S. Pat. No. 4,353,008 to Dorfman discloses a plurality of light sources controlled by drum. Lamps are positioned between drum heads. (Dorfman, col. 10, lns. 35–39. The output from a comparator 108 which controls a light is either all on for strong impacts to drum; all off for extraneous noises; or a series of pulses whose on-time to off-time ratio is a direct function of the input level provided by a peak detector 106. (Dorfman, col. 6, lns. 3–8). Pulse former 112 is used to warm lamps. (Dorfman, col. 7, lns. 19–31). Dorfman also discloses a microphone pickup 200. (Dorfman, col. 8, lns. 19–30).

SUMMARY OF THE INVENTION

The present invention in one embodiment is comprised of a light socket located within a drum. The light socket is preferably attached to a bracket. A microphone is also preferably attached to the same bracket. An audio signal is preferably picked up by the microphone, is amplified, inverted, and used to regulate and control a D.C. voltage to a relay which controls the A.C. power to the light socket and a light to be placed within the light socket. Preferably the on-off state requirements of a transistor are used as a threshold for turning the light on. Preferably, the bracket is attached to a tube which is inserted through an existing air hole in the drum.

DETAILED DESCRIPTION OF THE DRAWINGS

Figure 1:
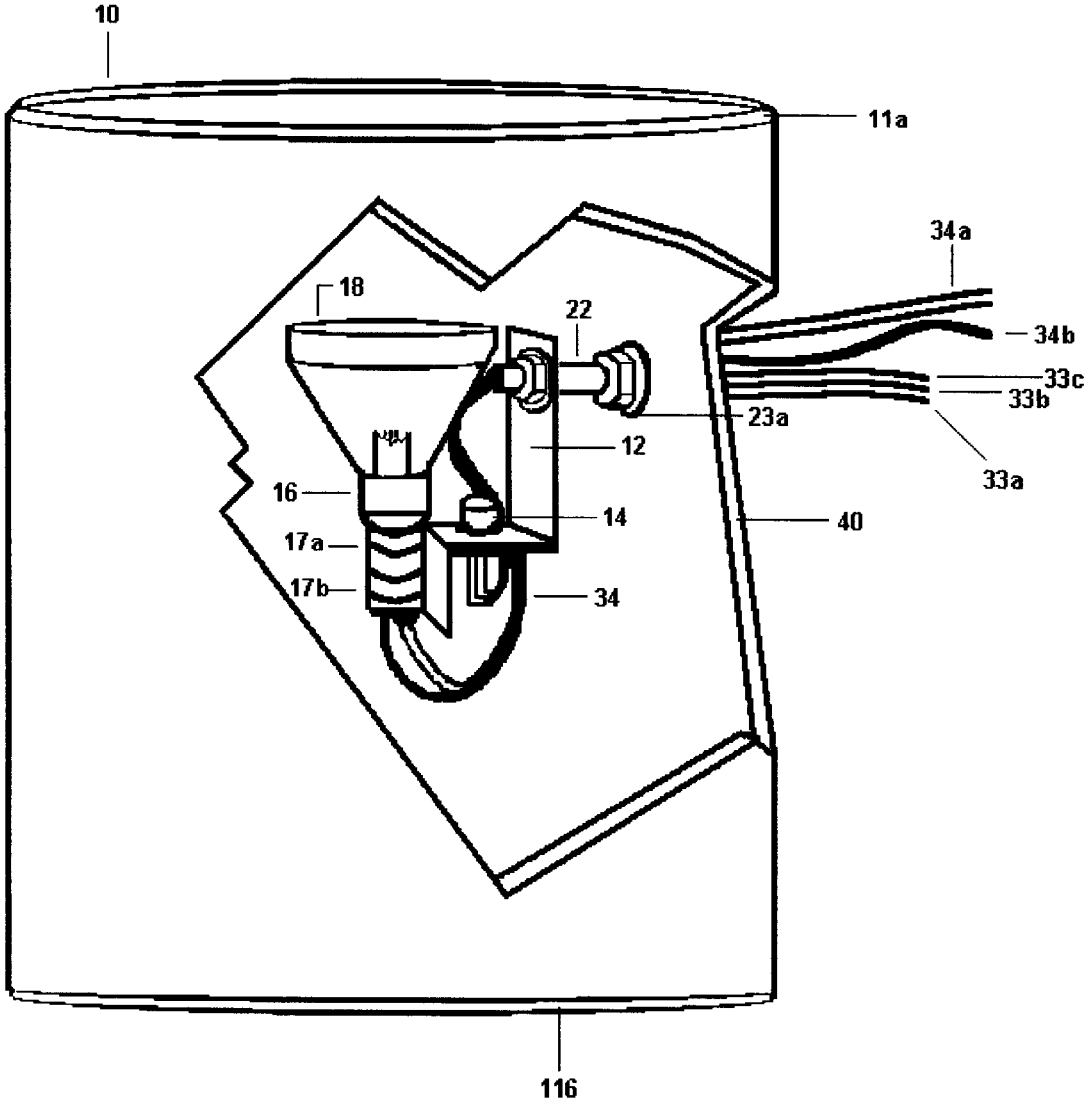
FIG. 1 shows a drum having a bracket with a microphone and a light socket attached in accordance with an embodiment of the present invention.

FIG. 1 shows a drum 10 having a bracket 12 with a microphone 14 and a light socket 16 attached to the bracket in accordance with an embodiment of the present invention. Light bulb 18 is shown screwed into the socket 16. Threaded tube 22 is shown in FIG. 1 for attaching the bracket 12 to the shell 40 of the drum 10. The threaded tube 22 is preferably hollow for allowing cable to pass through. The threaded tube 22 is preferably metal.

Figure 2:
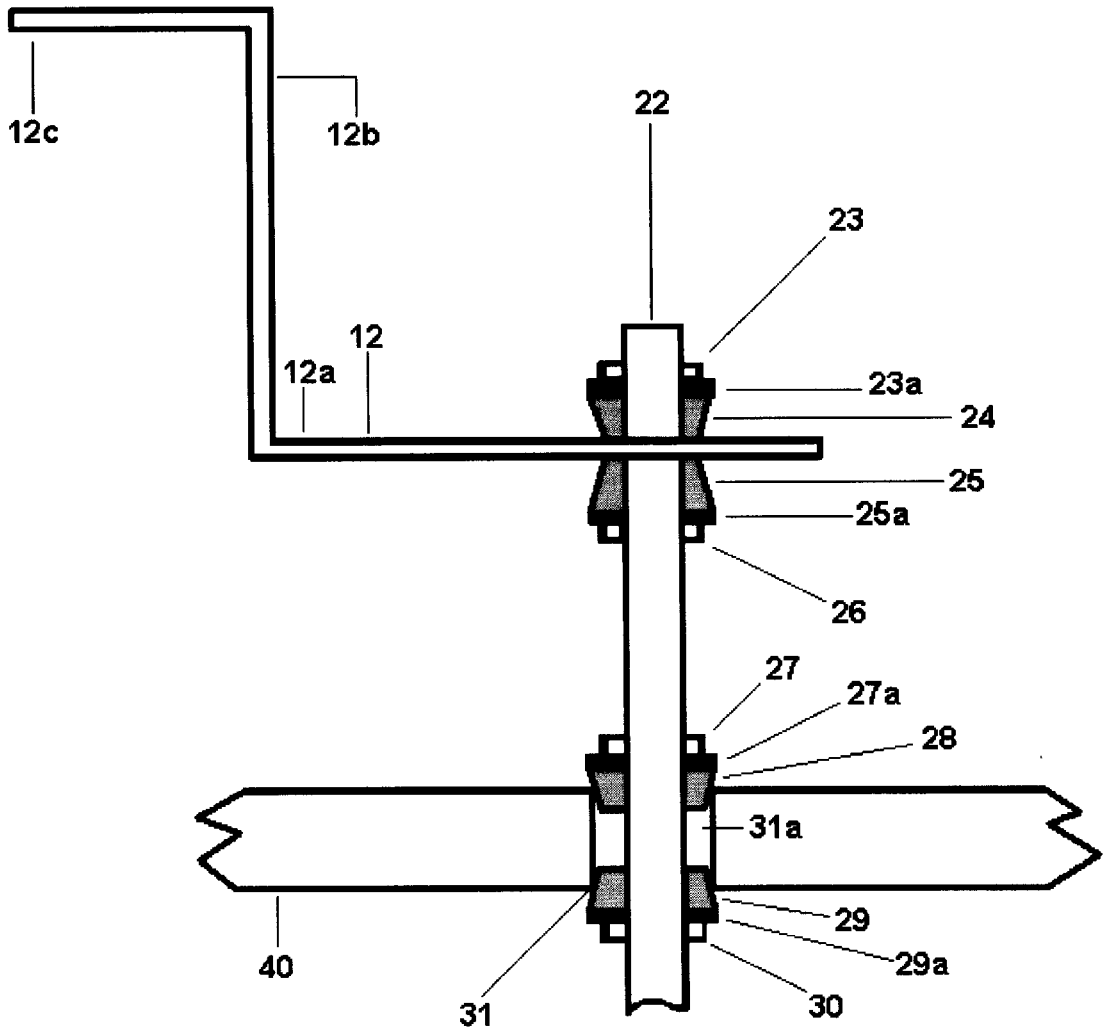
FIG. 2 shows a detailed diagram of a threaded tube for attaching the bracket of FIG. 1 to the drum of FIG. 1; please provide.
Figure 3:
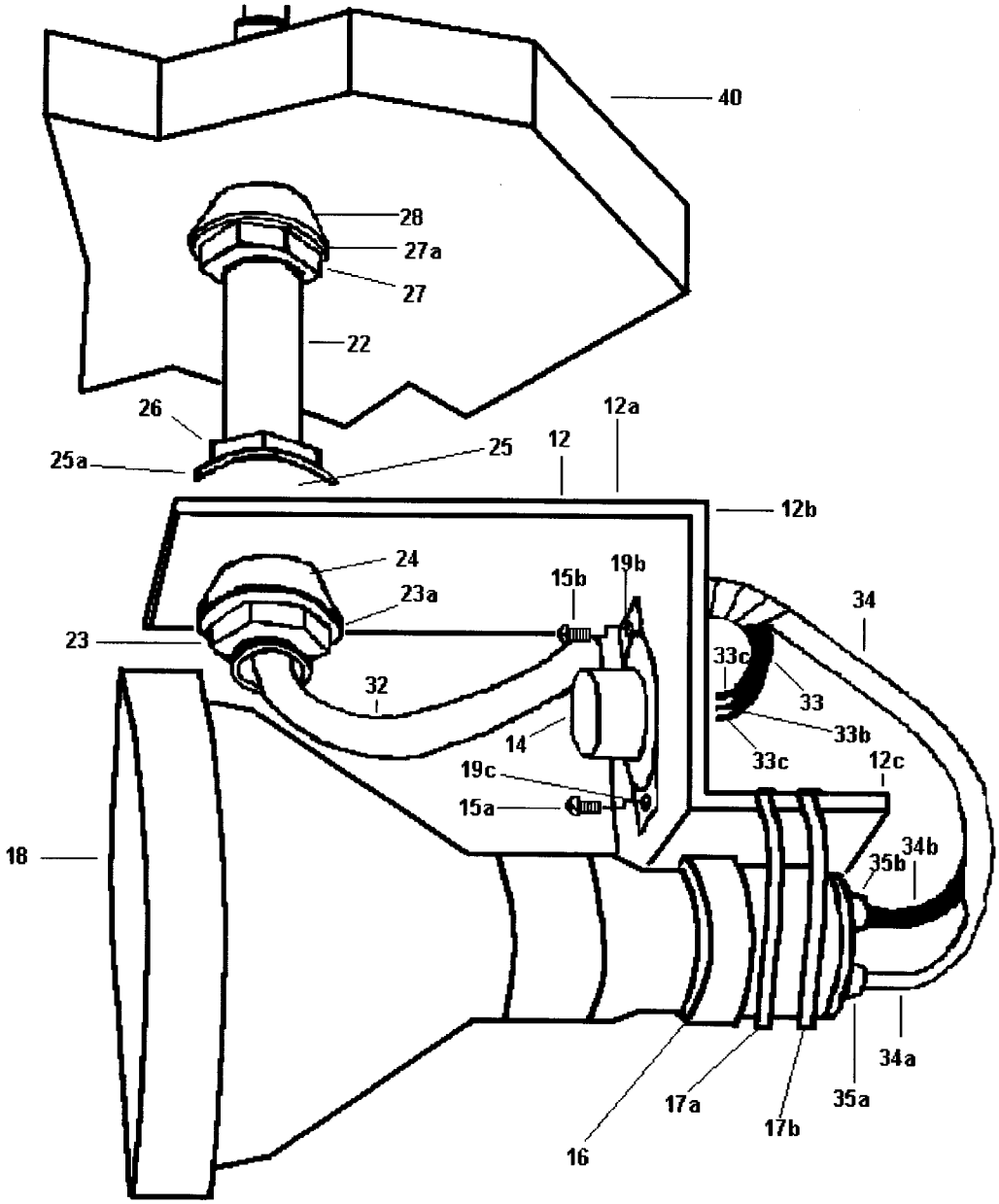
FIG. 3 shows a detailed diagram of the bracket of FIG. 1 with a microphone and a light socket attached.

Referring to FIGS. 1, 2, and 3 the drum 10 and the various pieces for implementing the bracket 12, microphone 14, and light socket 16 will be described in more detail. The drum 10 includes a top head 11*a* and a bottom head 11*b* as shown in FIG. 1. The bracket 12 includes a vertical portion 12*a*, a horizontal portion 12*b*, and a vertical portion 12*c*, as shown in FIGS. 2 and 3. The vertical portion 12*a* preferably lies at an approximately ninety degree angle with respect to the horizontal portion 12*b*. The horizontal portion 12*b* lies at an approximately ninety degree angel with respect to the vertical portion 12*c*. This arrangement allows the bracket 12 to be connected securely and efficiently while also allowing the microphone 14 to point upwards towards the top head 11*a* of the drum 10. The microphone 14 includes attaching portion 21 which can be attached to horizontal portion 12*b* of bracket 12 as shown in FIG. 3. The attaching portion 21 has two holes 19*a* and 19*b* through which screws 15*a* and 15*b* can be inserted, respectively. Preferably there are threaded corresponding holes in portion 12*b* of bracket 12 which allow the screws 15*a* and 15*b* to be inserted into portion 12*b* of bracket 12 and thus fasten microphone 14 to portion 12*b* of bracket 12.

The socket 16 can be attached to the portion 12*c* of the bracket 12 by nylon wire ties 17*a* and 17*b* as shown in FIG. 3. Threaded tube 22 enters through the shell 40 of the drum 10. The shell 40 is usually made of wood. Portion 12*a* of the bracket 12 is fastened to threaded tube 22 and held by nut 23, washer 23*a*, grommet 24, nut 25, washer 25*a* and grommet 26 as shown in FIGS. 2 and 3. The grommets 24, 25, 28, and 29 are used for shock mounting to dampen the vibration of the threaded tube 22 and the bracket 12 and generally to promote stability. This is among other things to prevent the threaded tube 22 and bracket 12, microphone 14, light socket 16 etc. from rattling or making noises when the drum 10 is struck, i.e. the drum 10 should make the same noises it normally makes and not different noises. The grommets 24, 25, 28, and 29 are preferably rubber. Washer 23*a*, should be placed between the nut 23 and the grommet 24 and washer 25*a* should be placed between the nut 25 and the grommet 26. The washers 23*a*, 25*a*, 27*a*, and 29*a* are preferably the same size and are larger than the grommets 24, 25, 28, and 29. The grommets 24, 25, 28, and 29 are preferably the same size. The washers 23*a*, 25*a*, 27*a*, and 29*a* are preferably big enough in diameter so that they compress the grommets 24, 25, 28, and 29 evenly, i.e. for example the washer 23*a* may be one and a half times (1.5) larger in diameter than the grommet 24. Threaded tube 22 is also fastened to drum shell 40 by nut 27, washer 27*a*, grommet 28, washer 29*a*, nut 29, and grommet 30. The grommets are used as shock mounting so that the threaded tube 22 does not come in direct contact with the drum shell 40. The grommets are preferably rubber. Washer 27*a*, is placed between the nut 27 and the grommet 28 and washer 29*a* is placed between the nut 29 and the grommet 30. This results in less undesired vibrations from being transmitted from the shell 40 to the microphone 14. The threaded tube 22 is a hollow cylinder which allows cable shroud 32 to pass through from inside the drum 10 to outside the drum 10. The cable shroud 32 includes cables 33 and 34 inside the drum 10. Cable 33 includes conductors 33*a*, 33*b*, and 33*c*. Cable 33 is preferably an 18 guage two-conductor plus braided shield cable. Conductors 33*a*, 33*b*, and 33*c* are connected to the ground, positive, and negative terminals of the microphone 14 (terminals are not shown). Cable 34 includes conductors 34*a* and 34*b*. Cable 34 is a 14 or 16 guage two-conductor non-shielded cable suitable for A.C. (alternating current −60 hz., 120 volts, power). Conductor 34*a* connects to terminal 35*a* and conductor 34*b* connects to terminal 35*b*.

Figure 4:
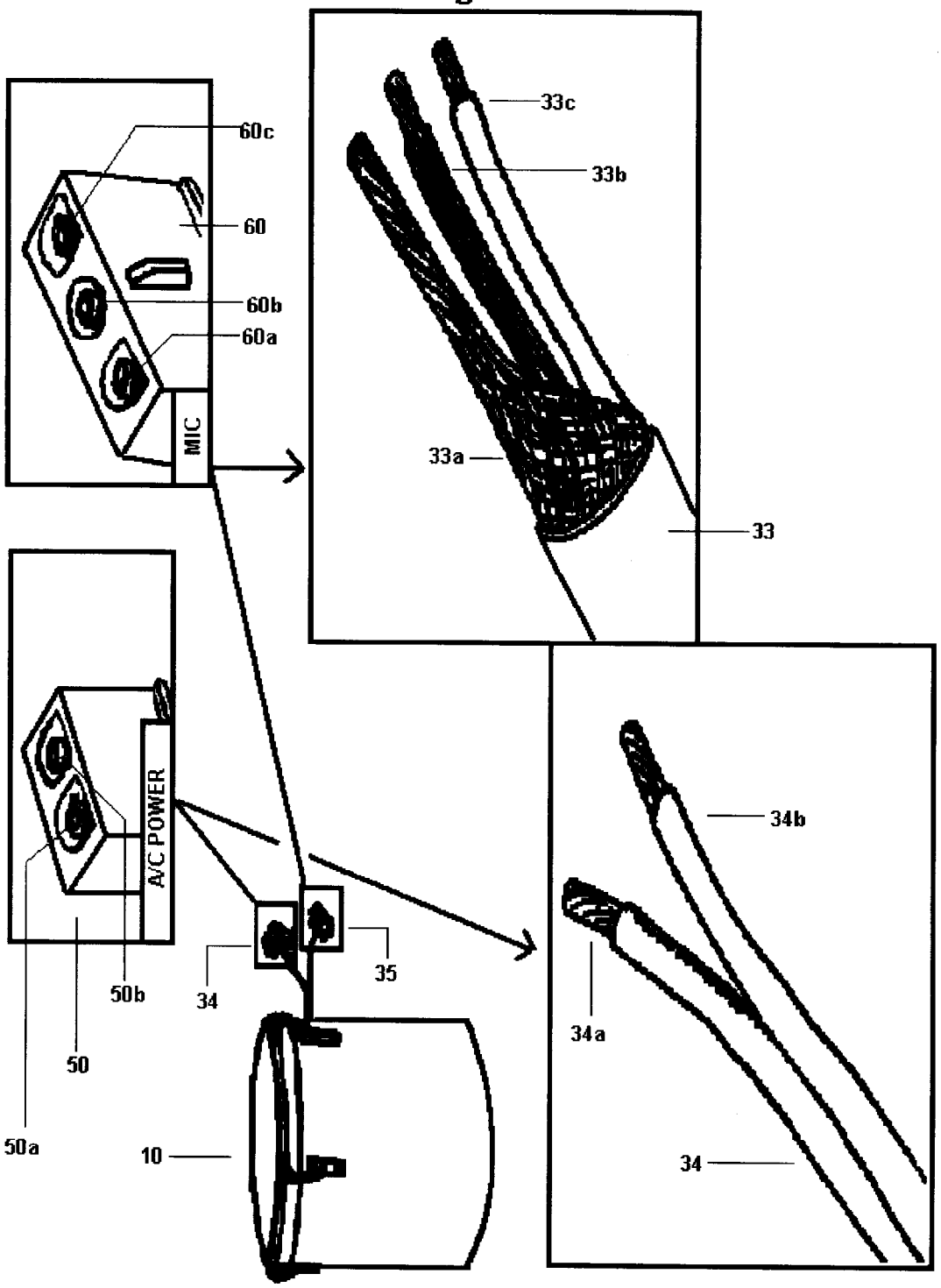
FIG. 4 shows outside circuitry for connecting cables from drums.
Figure 5:
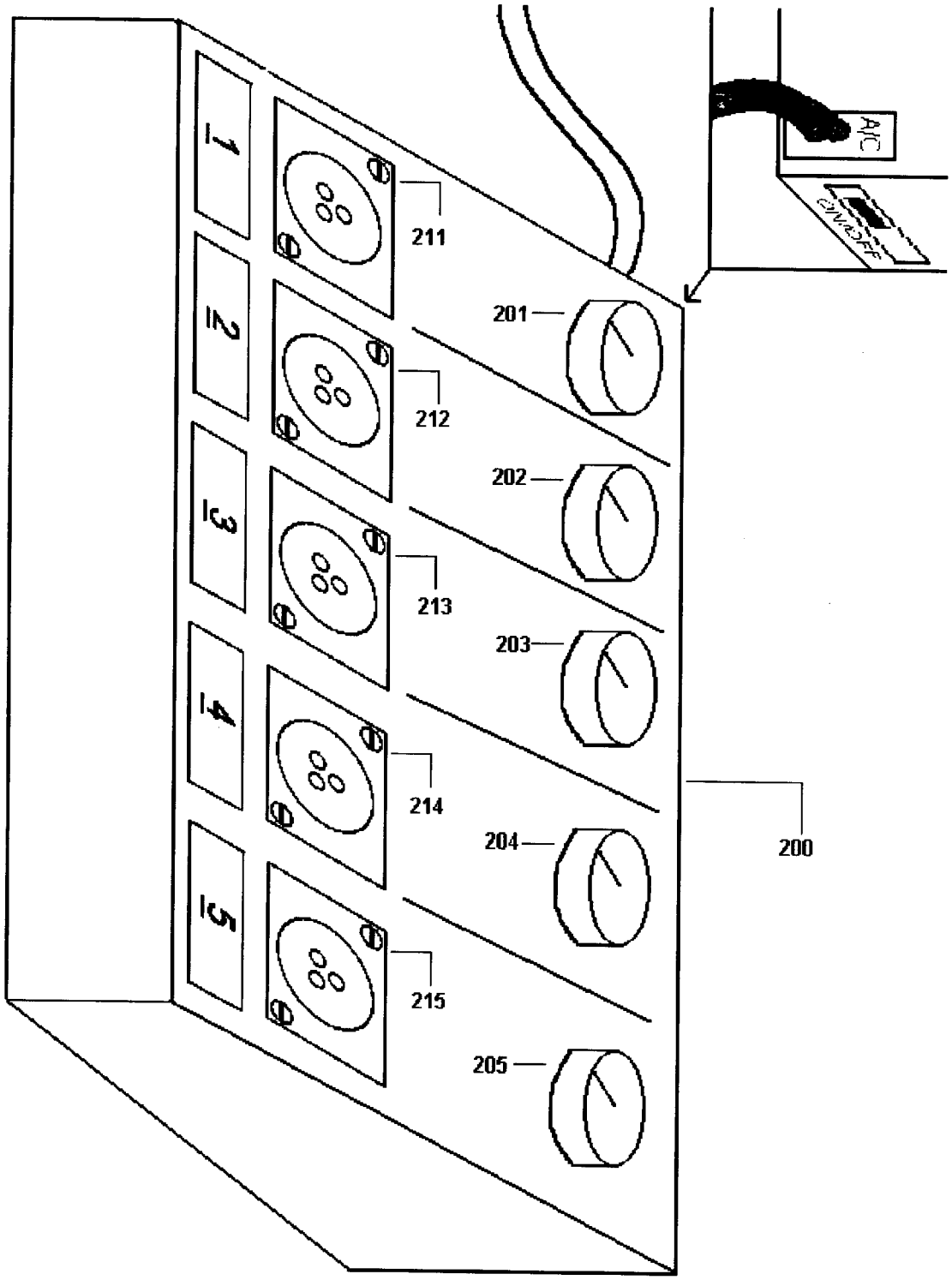
FIG. 5 shows housing for the circuitry of FIG. 6.
Figure 6:
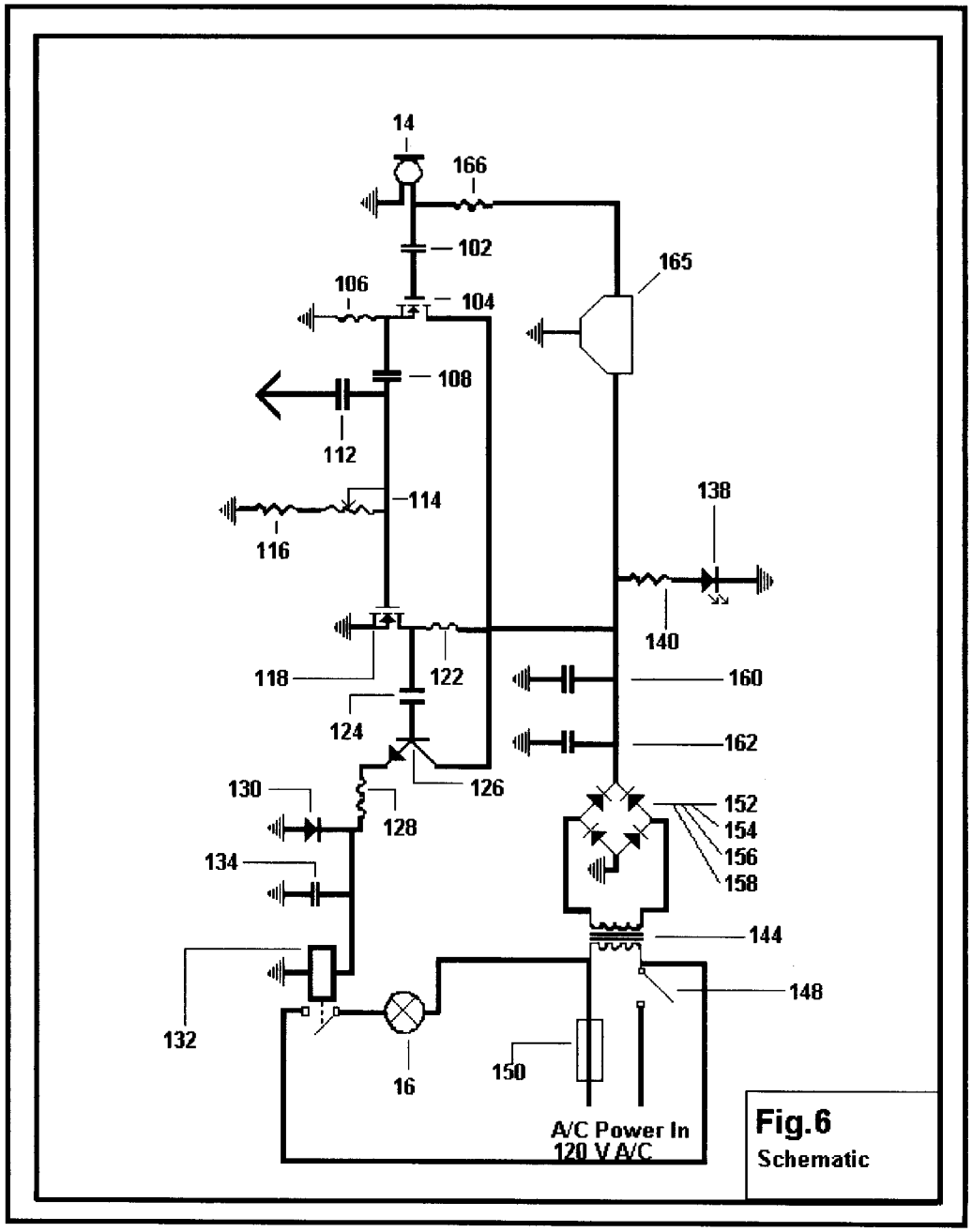
FIG. 6 is circuitry for use in one embodiment of the present invention.

FIG. 4 shows the cables 34 and 33 outside the drum 10. Cable 34 is connected to an output port of a control channel of the control unit 200 for circuitry shown in FIG. 6. Cable 33 is connected to a connector 60 by connecting portions 33*a*, 33*b*, and 33*c* to ground, positive, and negative terminals 60*a*, 60*b*, and 60*c*, respectively. FIG. 5 shows the control unit 200 which houses the circuitry of FIG. 6. The housing 200 includes controls 201, 202, 203, 204, and 205 which control the potentiometer 114. FIG. 5 shows standard XLR microphone output connectors 211, 212, 213, 214, and 215, which correspond to output 109 and can be supplied to a mixer/recorder 110 as shown in FIGS. 5 and 6.

The light bulb 18 is preferably a colored flood light. The light socket 16 is preferably a rubber socket for shock mounting to bracket 12, durability, ease of assembly, availability, non-conductivity for safety, and eventual Underwriters Laboratory ("UL") listing if needed. The microphone 14 is preferably a unidirectional condenser microphone, such as the Panasonic (trademark) #WM-55A 103.

The threaded tube 22 enters the drum 10 through a pre-existing air hole 31 and preferably through a metal ring 31*a* which is placed in the air hole 31 in the shell 40 as shown in FIG. 2. Typically the metal ring 31*a* is pre-existing in a drum, if it is not, then a metal ring 31*a* need not be inserted. Air holes such as air hole 31 are typically present in conventional drums. Cable 34 may have detachable cabling so that it can easily be attached and detached from a connector 50 having terminals 50*a* and 50*b*, which can be connected to an A.C. power source so that the cable 34 is electrically connected to an A.C. power source. Cable 33 may also have detachable cabling and so that is can be easily attached or detached to a connector 60, having terminal 60*a*, 60*b*, and 60*c*, which preferably is connected through further cabling to the control unit 200, so that cable 33 is electrically connected to control unit 200. Cable 33 is preferably a three conductor (shield or ground is the third conductor) microphone cable Mogami (trademark) 18/2 (18 gauge wire diameter, 2 is the number of conductors not including ground) braided shield cable for attaching to the connector 60 which leads to control unit 200.

The threaded tube 22 is comprised of basically a piece of externally threaded conduit with high rigidity and tensile strength. The threaded tube 22 is preferably approximately six inches long with an external diameter able to fit into the metal ring 31*a*. The inside diameter of the hollow threaded tube 22 should be able to accomodate the A.C. light cable 34 and the microphone cable 33.

When the drum top head 11*a* of the drum 10 is hit in a traditional manner, such as with a drum stick, the microphone 14 picks up the soundwaves and converts them to an A.C. Audio Signal. The A.C. Audio Signal passed though the cable 33 and into the circuitry 100 shown in FIG. 6.

The A.C. audio signal passes from the microphone 14 through the coupling capacitor 102 and then into the gate of the field effect transistor ("FET") 104. The FET 104 may be a 2N3819 Field Effect Transistor N-channel type from Radio Shack (trademark) having electrical characteristics of the following Absolute Maximum Ratings: $BV_{gss}$ of 25 volts, $P_D$ of 360 milliwatts, $V_{gs}$ (OFF) of −3.5 volts, and a Noise Figure of 2.5 decibels. The FET 104 may have the followings typical characteristics at $V_{ds}$ 15 volts: $G_{fs}$ of 5.0 mmhos, and $I_{dss}$ of 10 milliamps. The FET 104 may be of the type designed as a high frequency, low-noise RF amplifier, mixer and switch.

The coupling capacitor 102 may have a value of 10 microfarads and is designed to block D.C. signals but to allow a full range of A.C. audio signals to pass through. The FET transistor 104 is configured for current gain and to match the impedance of the microphone 14. After the audio signal has passed through the FET transistor 104 it's current has been amplied by the ratio of the voltage input to the FET transistor 104 ($V_{in}$ divided by the resistance of a resistor 106, $R_1$ which is also called the load resistor, i.e. the ratio of $V_{in}/R_1$. Resistor 106, is the load resistor and limits current flow through the amplifier unit which is comprised of the FET transistor 104. The resistor 106 typically has a value of 2.2 kilo-ohms. The signal from the output of the FET transistor 104 is taken from point 104*a* and applied to coupling capacitor 108. The coupling capacitor 108 has a value of 10 microfarads and is designed to block D.C. signals from passing through, but allow full range audio to pass. The output signal from the coupling capacitor 108 is applied to the mixer/recorder 110 through a coupling capacitor 112. Coupling capacitor 112 may have a value of 20 to 100 microfarads. The mixer/recorder 110 can alternatively be replaced with a tape recorder or any other device which accepts low impedance microphone inputs. A mixer/recorder 110 is shown in FIG. 5. The microphone inputs can be used to go to an external mixing board for recording and/or live sound, such as mixer/recorder 110. The output signal applied to the mixer/recorder 110 is essentially a low impedance, approximately two kilo-ohms, audio signal line out. The output signal from the coupling capacitor 108 is also applied to the gate of a metal oxide semiconductor field effect transistor ("MOSFET") 118. MOSFET 118, along with a capacitor 120, a potentiometer 114, and a resistor 116, is set up in a standard voltage and current amplifier common source configuration.

The MOSFET 118 can be a IFR510 Power MOSFET N-channel, 60 volt from Radio Shack, having the characteristics of extremely low on-state resistance, no secondary breakdown, very fast switching, low drive current, ease of paralleling and temperature stability, which is used in switching power supplies, inverters, choppers, motor controls, audio amps and high-energy pulse circuits. The MOSFET 118 is preferably a power metal oxide semiconductor FET ("MOSFET") having a brand name of IRC 510. The MOSFET 118 can have the Absolute maximum ratings of drain-source voltage: 100 volts, drain-gate voltage: 100 volts, continuous drain current: 4.0 amps, pulsed drain current: 16.0 amps, gate-source voltage 20 volts, maximum power dissipation of 20 watts. The MOSFET 118 can have electrical specifications of gate threshold voltage: 2.0 to 4.0 volts, on-state resistance of 0.54 ohms (max.), forward transconductance 1.0 mhos, input capacitance 150 pfarads (max.), output capacitance: 100 pfarads (max.).

The MOSFET 118 takes the signal at its input, 118*a* and produces an exact but inverted reproduction; i.e. changed in phase by 180 degrees, at its output 118*c*. The threshold control of the MOSFET 118 is controlled by the resitance of potentiometer 114 in series with resistor 116. The value of potentiometer 114 controls the bias voltage of the MOSFET 118, which requires 3.5 volts to switch to an on state. The capacitor 120 has a value of 47 picofarads for low pass filtering of R.F. (radio frequency) signals that would create interference. The potentiometer 114 is a 100 kilo-ohm potentiometer. The resistor 118 has a value of 60 kiloohms. A resistor 122, which is the load resistor of the Mosfet Amplifier cirucitry and which has a value of 2.2 kilo-ohms, is connected to a node 170 of a bridge rectifier 151 comprised of diodes 152, 154, 156, and 158. At the node 170 is the filtered output of the bridge rectifier 151, filtered by capacitors 160 and 162. THe bridge rectifier 151, the capacitors 160 and 162, and the transformer comprised of windings 144 and 146 form the power supply, from which all components in the circuit directly or indirectly get their power from. The bridge rectifier 151 produces a fairly consistent voltage supply of 18.05 volts D.C., though it may fluctuate slightly.

The output signal from the MOSFET 118 is applied to a coupling capacitor 124, which has a value of 10 microfarads to block D.C. signals but to allow passage of a full range of A.C. audio signals. The output signal from the coupling capacitor 124 is applied to a base 126*a* of a transistor 126 which can be a TIP31 31 Transistor NPN Silicon, from Radio Shack (trademark) having characteristics of $h_{fe}$ (min.): 10–50, Absolute Maximum ratings of $V_{CBO}$ of 40 Volts, $V_{CEO}$ of 40 Volts, $V_{EBO}$ of 5 volts, $I_C$ of 3 Amps and $f_T$ of 3 MHz, Dissipation of 20 Watts, Derated at 150 degrees Celsius, and designed for applications such as Audio Power and other high-speed switching circuits.

The transistor 126 is used as a trigger in a switching configuration turn on relay 132. The transistor 126 has an on state of 0.7 volts. When the transistor 126 is switched on the current flowing through the transistor 126 turns the sharp solid state relay 132 on. The transistor 126 preferably remains on for the same duration as the tone produced by the striking the drum 10, which is picked up by the microphone 14. When the transistor 126 is on, the light socket 16 and thus the light bulb 18 are also on. Also the brightness of the light bulb 18 increases when the volume of the sound made by hitting the drum 10 rises when adjusted for such, by varying potentiometer 114 for level setting purposes.

Resistor 128, whose value is 150 ohms is used to protect the S.S. relay 132 from excess voltage and current. Capacitor 134, whose value is 10 microfarads is used as a switch debouncer, and diode 130 is used as a trigger diode for switching. Both the diode 130 and capacitor 134 are used to promote stable switching operation. The diode 130 may be a 1 kilovolt, 2.5 Amp, silicon diode from Radio Shack (trademark) which has absolute Maximum Ratings (at 25 degrees C.) of a Peak Inverse Voltage (PIV) 1000 volts, a forward voltage drop (Vf) at If: 1 volt, Forward Current (If): 2.5A, maximum surge current (16 ms) 80 Amps, Reverse Current at PIV: 1 microAmps, of a type which can be used in high-current/voltage circuits.

The relay 132 is preferably a Sharp Solid State Relay such as a solid state relay from Radio Shack (trademark) rated at 3 Amps, 125 VAC, Switch A.C. with low voltage D.C. The relay 132 may have a control voltage of 1.2 VDC, a control current of 20–50 milliamps, a load voltage of 400 VAC peak (max.), and a load current of 3 amps max.

When the relay 132 is turned on, 120 volts A.C. are connected across the socket 16 and thus the light bulb 18 lights, as shown by FIGS. 1 and 6. The zener diode 136 may be a 1N4733 5.1 Volt Zener Diode from Radio Shack. The zener diode may have the following electrical characteristics: voltage Vz 5.1 volts, current Iz, 49 mAmps, and maximum power dissipation of 1.0 Watts.

The zener diode 136 is used as a voltage regulator for the Light Emitting Diode ("LED") 138. The LED 138 can be a green light-emitting diode T-1 and ¾ size, from Radio Shack (trademark) having absolute Maximum Ratings (at 25 degrees Celsius) of power dissipation of 75 milliwatts, of forward current of 25 milliamps, and also having Optoelectrical characteristics at 10 milliAmps of a Forward Voltage of 2.1 Volts and a Luminous intensity of 6.3 mcd.

The LED 138 indicates whether the circuitry 100 is on so that the light bulb 18 in the socket 16 can be lit. The resistor 140 has a value of 1.5 kilo-ohms and is used to protect the LED from Excess Current. The diode 142 is used to convert an A.C. signal to a pulsed D.C. signal. A 120 volt A.C. signal is supplied to a primary winding 144 during operation of the circuitry 100. A secondary winding 146 derives a 12.6 volt A.C. signal from the signal of the primary winding. The 12.6 volt A.C. signal is then turned into D.C. by the bridge rectifier 151 comprised of diodes 152, 154, 156, and 158. The capacitor 160, having a value of 4700 microfarads, and the capacitor 162 having a value of 4700 microfarads are power supply filter capacitors for the D.C. voltage. The D.C. output of 18.05 volts is obtained at the node 170. Because of the capacitors 160 and 162 the voltage goes up to 18.05 volts approximately with no load. The 18.05 volt supply is also connectd to the input 165*a* of the voltage regulator 165. The voltage regulator 165 can be a chip number 7805 +5 VDC Voltage Regulator, 1 Amp from Radio Shack, having the characteristics of internal thermal overload protection, stable fixed output voltage, up to 1.0 amps of output current, output transistor safe area protection and internal short-circuit current limit. The voltage regulator 165 can also have the following absolute maxium ratings of input voltage: 35 volts, operating temperature of 0 degrees to 70 degrees Celsius, and maximum junction temperature of 150 degrees Celsius.

The voltage regulator 165 in conjunction with the capacitor 168, having a value of 10 microfarads and the resistor 166 having a value of 2.2 kilo-ohoms are used to provide a five volt supply to microphone 14 and other microphones not shown of a five channel unit. The primary winding 144 is also attached to the fuse 150. The switch 148 is used to turn the circuitry 100 on or off.

The general operation of an embodiment of the present invention is as follows. An individual takes a drum stick or a bass drum pedal and hits the top drum head 11*a* of the drum 10 shown in FIG. 1. The sound is picked up by the microphone 14 which changes deviations in air pressure into an A.C. audio signal. The audio signal passes through a microphone cable 33 which exits the threaded tube 22. The positive portion 33*b* of the microphone cable 33 is attached to the coupling capactor 102 as shown in FIG. 5. The audio signal is amplified by the FET 104 and then sent via capacitors 112 to the recorder/mixer 110. The amplified signal is also sent to the Power MOSFET 118 via capacitor 108 then to the switching transistor 126 and to the relay 132 which turns on the light 18. All the circuitry controls whether the light socket 16 and thus the light 18 will be turned on. Preferably any A.C. voltage lower than a combination of voltage and current of 3.5 volts A.C. times $V_{in}/R_1$ (as defined previously) produced at gate 118*a* of the MOSFET 118, will not produce a light pattern. However the adjustment of potentiometer 114 turned to increase sensitivity can add a substantial D.C. signal to the A.C. input at gate 118*a* allowing softer hits to produce a brighter light response. If the A.C. input at gate 118*a* is greater than 3.5 volts, the MOSFET 118 will be triggered. Afterwards to the switching transistor 126. The switching transistor 126 turns on the relay 132 which lights the light 16.

Please note that all of the above component values are exemplary and that other component values can be used.

Preferably the drum 10 is part of a set of drums, each of which includes a microphone such as microphone 14. The internally mounted microphones of the plurality of drums function as a set of microphones suitable for recording or sound reinforcement of a drum set.

The present invention in some embodiments can be used by drummers wishing to add another dimension to their playing by adding a colorful personalized light show with dazzling effects. Also since the microphones may be sent to an external unit such as mixer/recorder 110 there is no need to re-microphone or "re-mike" or "re-mic" a set (which means to place additional microphones on or around a drumset for sound reinforcement or recording purposes) because the microphones (for multiple drums embodiments) are already in the drumset, thanks to the present invention. This is extremely practical and useful for club dates, touring, live shows, and recording applications. Some embodiments of the present invention can also be helpful in drum clinics as allowing a closer following of exactly what a clinician is doing. In teaching it can help with patterns and applications of rhythms. And, as a practicing tool it can teach consistency in striking technique as well.

In Big clubs and arenas drums are not heard unless microphoned "miked" for amplification through a public address ("P.A.") system. The output from standard XLR connectors such as connectors 211–215 shown in FIG. 5, can send the microphone output to a P.A. system, such as mixer/recorder 110. This is output 109 of FIG. 6, which is an output after the first amplification stage, i.e. after the FET transistor 104.

The present invention in the embodiment described with reference to FIGS. 1 through 6 preferably uses only one light socket and bulb, per drum, although more sockets and lights can be used, in an individual drum. Preferably an incandescent light bulb is used, to produce various lighting effects such as variations in brightness.

Although a comparator could be employed the embodiment described preferably does not use a comparator. A comparator is typically employed in other types of circuits as a logic switching device which measures an input signal against a control voltage and then depending on whether that voltage is higher than the control voltage, switches a transistor or other switching device to an on state or an off state. A comparator is unnecessary in the preferred embodiment of the present invention because the circuitry of the emobidment desribed in FIGS. 1–6 is built and designed around the on/off state voltage and amperage requirements of the transistors and relays used in the circuitry. This reduces the need for voltage controlling circuitry for a reference voltage and then less noise can be introduced to thru signals for extraneous use with recording or mixing boards.

There is no need for a peak meter because the drum 10 has the light 18 inside it and the light 18 brightness and sensitivity and duration are all preferably controlled from one potentiometer 114 for adjustability. When the signal is picked up by the preferably unidirectional condenser microphone 14 in the drum 10 (unidirectional cuts down on bleed and crosstalk from other drums so as to help prevent false triggers) it is preferably sent to the input stage FET 104 for impedance matching and current amplification only, the next stage The next transistor stage is the power mosfet 118 which is configured to amplify the a.c. audio signal from the F.E.T. 104 not only by current but also by voltage. The output of this stage is also coupled to the next by a capacitor for exactly the same reasons as listed. I.e for blocking D.C. signals. The next stage is a Bipolar Transistor 126 configured in a switching mode when the amplified signal from the Mosfet amplifier reaches a certain voltage at a certain current (greater than 0.7 volts at D.C. power supply current) it allows the Bipolar transistor 126 switch to turn on (forward biased). This allows the D.C. voltage from the power supply, as obtained from node 170, (minus the used voltage and current by the other circuit components)—to go to the sharp solid state relay 132 and activate it so it allows the 120 volt A.C. power from standard household supply to go to the socket 16 and the light bulb 18. The A.C. is taken from the connection of the Power Transformer primary winding 144 of FIG. 6.

This embodiment thus uses a stable, constant, filtered D.C. voltage to control the 120 volt A.C. at the relay 132 thereby eliminating the flickering or any other problems associated with controlling the relay 132 with a fluctuating A.C. voltage. This means that a very accurate tracking of the light to the sound produced by the drum would be achieved.

There is a brief warming period of the circuitry for resistors, about five minutes under normal operating conditions, but no light warming or other similar processes are necessary. Also the transients of the drum 10 directly correlate to transients of the light 18 because the stronger the A.C. Audio signal picked up by the microphone 14, the more D.C. voltage gets applied to the relay so that it may increase in light brightness up until its brightest point or most conductivity of the 120 volt A.C. main supply. No oscillator is typically necessary and if used would probably cut down on dynamic response of light to drum.

I claim:

1. An apparatus comprising:

a drum comprised of a shell and a top head;

a light socket within the drum;

a transducer within the drum;

a bracket within the drum to which the light socket and the transducer are attached, the bracket attached to the shell of the drum; and means for electrically connecting the transducer with the light socket and causing a light placed within the light socket to turn on when the drum is hit and the sound from hitting the drum exceeds a threshold and wherein: the shell of the drum has an air hole;

the bracket is attached to a hollow tube which has been placed through the air hole so that a portion of the hollow tube lies outside the drum and a portion of the hollow tube lies inside the drum.

2. The apparatus of claim 1 further comprising:

a first and a second cable, said first and second cables passing through the hollow tube, the first cable providing electrical connection to the light socket and the second cable providing electrical connection to the transducer.

3. The apparatus of claim 1 further comprising:

means for shock mounting;

wherein the means for shock mounting mounts the hollow tube to the shell to inhibit the hollow tube from vibrating when the drum is hit.

4. The apparatus of claim 3 wherein:

the means for shock mounting is comprised of a first and second grommet.

5. The apparatus of claim 1 and wherein:

the bracket is comprised of a first portion which connects to the shell and a second portion which lies at an angle with respect to the first portion, said second portion having the transducer connected to it.

6. The apparatus of claim 5 wherein the second portion of the bracket lies at approximately a ninety degree angle with respect to the first portion of the bracket.

7. The apparatus of claim 5 wherein:

the bracket is comprised of a third portion which connects to the light socket, the third portion lying at an angle with respect to the second portion.

8. The apparatus of claim 7 wherein:

the third portion of the bracket lies at an approximately ninety degree angle with respect to the second portion of the bracket.

9. An apparatus comprising:

a drum comprised of an shell, and a top head;

a light socket within the drum;

a transducer within the drum;

a bracket within the drum to which the light socket and the transducer are attached, the bracket attached to the shell of the drum; and circuitry comprised of a transistor having an input and an output, said transistor having an input threshold, the input of the transistor electrically connected to the transducer and the output of the transistor electrically connected to the light socket, wherein the transistor causes a light placed within the light socket to turn on when the drum is hit and the sound from hitting the drum causes the transducer to produce a signal which exceeds the input threshold of the transistor;

and wherein:

the shell of the drum has an air hole;

the bracket is attached to a hollow tube which has been placed through the air hole so that a portion of the hollow tube lies outside the drum and a portion of the hollow tube lies inside the drum.

10. The apparatus of claim 9 further comprising:

a first and a second cable, said first and second cables passing through the hollow tube, the first cable providing electrical connection to the light socket and the second cable providing electrical connection to the transducer.

11. The apparatus of claim 9 further comprising:

means for shock mounting;

wherein the means for shock mounting mounts the hollow tube to the shell to inhibit the hollow tube from vibrating when the drum is hit.

12. The apparatus of claim 11 wherein:

the means for shock mounting is comprised of a first and second grommet.

13. An apparatus comprising:

a drum comprised of an shell, and a top head;

a light socket within the drum;

a transducer within the drum;

a bracket within the drum to which the light socket and the transducer are attached, the bracket attached to the shell of the drum; and circuitry comprised of a transistor having an input and an output, said transistor having an input threshold, the input of the transistor connected to the transducer and the output of the transistor connected to the light socket, wherein the transistor causes a light placed within the light socket to turn on when the drum is hit and the sound from hitting the drum causes the transducer to produce a signal which exceeds the input threshold of the transistor;

and wherein:

the bracket is comprised of a first portion which connects to the shell and a second portion which lies at an angle with respect to the first portion, said second portion having the transducer connected to it.

14. The apparatus of claim 13 wherein the second portion of the bracket lies at approximately a ninety degree angle with respect to the first portion of the bracket.

15. The apparatus of claim 13 wherein:

the bracket is comprised of a third portion which connects to the light socket, the third portion lying at an angle with respect to the second portion.

16. The apparatus of claim 15 wherein:

the third portion of the bracket lies at an approximately ninety degree angle with respect to the second portion of the bracket.

* * * * *